US005078898A

United States Patent [19]

Jars

[11] Patent Number: 5,078,898

[45] Date of Patent: Jan. 7, 1992

[54] DETERGENT COMPOSITIONS COMPRISING A *PEUDOMONAS LIPASE* AND A SPECIFIC PROTEASE

[75] Inventor: Mette U. Jars, Herlev, Denmark

[73] Assignee: Novo Nordisk A/S, Bagsvaerd, Denmark

[21] Appl. No.: 474,134

[22] PCT Filed: Nov. 1, 1988

[86] PCT No.: PCT/DK88/00177

§ 371 Date: May 4, 1990

§ 102(e) Date: May 4, 1990

[87] PCT Pub. No.: WO89/04361

PCT Pub. Date: May 18, 1989

[30] Foreign Application Priority Data

Nov. 2, 1987 [DK] Denmark ..... 5715/87

[51] Int. Cl.[5] ..... C11D 3/386; C11D 7/42

[52] U.S. Cl. ..... 252/174.12; 252/551; 252/552; 252/553; 252/555; 252/556; 252/558; 252/DIG. 12

[58] Field of Search ..... 252/174.12, DIG. 12. 252/551, 552, 553, 555, 556, 558; 435/264, 252.31, 929

[56] References Cited

U.S. PATENT DOCUMENTS

| | | | |
|---|---|---|---|
| 3,652,399 | 3/1972 | Isono et al. | 252/174.12 |
| 3,655,570 | 4/1972 | Isono et al. | 252/174.12 |
| 4,707,291 | 11/1987 | Thom et al. | 252/174.12 |
| 4,760,025 | 7/1988 | Estell et al. | 252/547 |
| 4,876,024 | 10/1989 | Enomoto et al. | 252/174.12 |
| 4,927,558 | 5/1990 | Aaslyng et al. | 252/174.12 |
| 4,933,287 | 6/1990 | Farin et al. | 252/174.12 |
| 4,980,288 | 12/1990 | Bryan et al. | 252/174.12 |

*Primary Examiner*—Paul Lieberman
*Assistant Examiner*—A. Beadles-Hay
*Attorney, Agent, or Firm*—Steve T. Zelson; Elias J. Lambiris

[57] ABSTRACT

Novel combinations of lipase and protease show better lipase stability in detergent solution than prior-art combinations. The lipase is derived from Pseudomonas. The protease can be a *Fusarium* protease, Subtilisin Novo or certain variants of the latter.

10 Claims, No Drawings

DETERGENT COMPOSITIONS COMPRISING A *PEUDOMONAS LIPASE* AND A SPECIFIC PROTEASE

This invention relates to a detergent composition comprising a protease and a lipase, and further to an enzymatic detergent additive comprising said enzymes.

BACKGROUND ART

Enzymatic detergent compositions are well known in the art. Enzymes of many types have been proposed for inclusion in detergent compositions, but the main attention has been focused on protease. Among the many proteases proposed for use in detergents, the following two are particularly relevant for this invention:

Subtilisin Novo, an alkaline serine protease derived from *Bacillus amyloliquefaciens,* see EP 130,756 (Genentech).

Alkaline protease of Fusarium, see e.g. U.S. Pat. No. 3,652,399 (Takeda) and DK 86/5640 (Novo).

Lipases have also been proposed as detergent ingredients, but there is still relatively little prior art dealing with lipases for this use. Of particular relevance to this invention is the proposed use of Pseudomonas lipase, see e.g. GB 1,372,034 (Unilever) and EP 214,761 (Novo).

Detergents containing lipase and protease are also known. However, as the lipase is a protein it is liable to digestion and deactivation by the protease in the detergent solution. Thus, data in EP 205,208 (Unilever) and EP 206,390 (Unilever) demonstrate that the stability of lipase from *Pseudomonas fluorescens* in detergent solution is seriously reduced by addition of protease from *Bacillus licheniformis* (Alcalase®) or from alkalophilic Bacillus sp. (Savinase® and Esperase®, trade marks of Novo Industri A/S).

Further, EP 130,064 (Novo), EP 214,761 (Novo) and WO 87/00859 (Gist-Brocades N.V.) disclose detergents with protease of *Bacillus licheniformis* (described as ALCALASE® and MAXATASE®, trade names of Novo and Gist-Brocades, respectively) and lipase of *Fusarium oxysporum, Pseudomonas cepacia, Ps. pseudoalcaligenes* or *Ps. stutzeri,* Stability data have not been published, but data in examples of this specification show that the stability of the lipase in these combinations is poor due to the influence of the protease.

It is the object of the invention to provide detergent compositions containing both lipase and protease, such that:

- the inclusion of each enzyme significantly improves detergency towards fatty and proteinaceous soiling, respectively
- each enzyme added separately shows good stability in a solution of the detergent, and
- the lipase shows less deactivation due to the protease in a solution of the detergent, and that hence the detergency towards fatty soiling is not significantly reduced by the protease.

Surprisingly, we have now discovered that all these objectives can be achieved by selecting a certain group of lipases and a certain group of proteases. Specifically, this combination of lipase and protease shows better lipase stability in detergent solution than the prior art.

STATEMENT OF THE INVENTION

The invention provides a detergent composition comprising a protease and a lipase. The protease is either Subtilisin Novo, a variant thereof (of a kind to be defined below) or a Fusarium protease. The lipase is derived from Pseudomonas.

The invention also provides an enzymatic detergent additive comprising said protease and said lipase.

DETAILED EXPLANATION OF THE INVENTION

Protease

The class of proteases that can be used in the present invention comprises proteases of Fusarium sp., Subtilisin Novo and certain variants of the latter.

Protease for use in the invention may be produced by cultivation of a strain of Fusarium sp., especially *F. oxysporum* and *F. solani.* Preferred strains include DSM 2672, IFO 5880, ATCC 659 and other strains listed in U.S. Pat. No. 3,652,399 (Takeda), as well as mutants and variants of these. Cultivation of the strains and recovery of protease may be done according to principles known in the art, U.S. Pat. No. 3,652,399.

Preferred Fusarium proteases for use in the invention are active in the pH range 7–12 especially 8–10.5, and most preferably they have pH optimum in such range.

The strain DSM 2672 was deposited on 6 June 1983 under the terms of the Budapest Treaty. It has been identified as *F. oxysporum.* The other strains are freely available to the public. DSM indicates Deutsche Sammlung von Mikroorganismen, West Germany (DSM), IFO stands for Institute of Fermentation, Osaka (IFO), and ATCC indicates American Type Culture Collection, U.S.A.

Subtilisin Novo is an alkaline protease from *Bacillus amyloquefaciens.* It has also been described under the synonyms BPN', Bacillus protease Nagarse, subtilopetidase B and subtilopeptidase C. See M. Ottesen and I. Svendsen, Methods in Enzymology, vol. 20, 199–210 (1971). Its amino acid sequence has been given in EP 199,404 (Procter & Gamble).

Variants of Subtilisin Novo that can be used in the invention are those wherein the Gly at position 166 is replaced with Asn, Ser, Lys, Arg, His, Gln, Ala or Glu; the Gly at position 169 is replaced with Ser; the Met at position 222 is replaced with Gln, Phe, Cys, His, Asn, Glu, Ala or Thr; the Gly at position 166 is replaced with Lys and the Met at position 222 is replaced with Cys; or the Gly at position 169 is replaced with Ala and the Met at position 222 is replaced with Ala. These variant proteases and their preparation are described in EP 130,756 (Genentech), incorporated herein by reference.

The proteases are preferably included in such an amount that the final detergent composition has a protease activity of 0.001–0.5 AU(A)/g.

Protease activity in Anson Units Alcalase, AU(A), is determined by digestion of dimethylcasein, relative to an Alcalase standard. The reaction is followed in situ by color formation with trinitrobenzene sulfonic acid, where the change in absorbance per time unit is measured. Conditions are: 37° C., pH 8.3, wave length 420 nm, reaction time 9 minutes, measuring time 3 minutes, e.g. on a Cobas Fara centrifugal analyser.

Lipases

The preferred Pseudomonas lipases for use in the invention are active in the pH range 7–12, especially 8–10.5, and most preferably have pH optimum in either of these ranges.

The most preferred lipases are those from *Ps. cepacia, Ps. fluorescens* and *Ps. fragi.*

Preferred *Ps. cepacia* strains are DSM 3333, DSM 3334, DSM 3335, DSM 3336, DSM 3337, DSM 3401, DSM 3959. The most preferred of these are DSM 3335, DSM 3401 and DSM 3959. Said strains were deposited under the terms of the Budapest Treaty on the following dates:

| Deposit No. | Deposit date |
|---|---|
| DSM 3333-3336 | 28 May 1985 |
| DSM 3337 | 10 Jun 1985 |
| DSM 3401 | 22 Jul 1985 |
| DSM 3959 | 30 Jan 1987 |

Another preferred strain is FRI 5494, deposited at The Fermentation Research Institute, Japan, and available therefrom with reference to Japanese examined patent publication JP 57-59,753-B2 (Agency of Industrial Science & Technology). *Ps. cepacia* lipase may be produced by cultivating these strains according to the referenced Japanese publication, to EP 214,761 (Novo) or to an example of this specification.

*Ps. fluorescens* lipase may be prepared according to JP 53-20,487A (Amano), JP 57-42,312B (Agency of Ind. Sci. & Tech.) or SU 491,693 (AS USSR Microbiol.) and is commercially available from Amano Pharmaceutical Co. Ltd., Nagoya, Japan, under the trade name Lipase P "Amano".

*Ps. fragi* lipase may be prepared according to JP 56-28,517B and EP 204,284 (Sapporo) and is commercially available from Sapporo Breweries Ltd., Japan, under the trade name Lipase-B, derived from *Ps. fragi* 22-39B.

Pseudomonas lipases for use in the invention may also be prepared according to the following references:

JP 56-28,515B (Sapporo): *Ps. nitroreducens*

JP 50-25,553B (Agency of Industrial Science & Technology): *Ps. mephitica* var. *lipolytica*

JP 48-103,791A (Amano)

JP 55-42,613B (Amano)

JP 49-45,592B (Amano)

JP 59-187,780A (Toyobo)

WO 87/00569 (Gist-Brocades): *Ps. stutzeri* and *Ps. pseudoalcoligenes*

GB 1,372,034 (Unilever): *Ps. stutzeri,* later reclassified as *Ps. aeruginosa* lipase ex *Ps. gladioli*

The lipases are preferably included in such an amount that the final detergent composition has a lipase activity of 20 LU/g-20,000 LU/g One lipase Unit (LU) is the amount of lipase which produces 1 μmole of titratable fatty acid per minute in a pH stat under the following conditions: 30° C., pH 7.0, tributyrin as substrate and gum arabic as emulsifier.

Surfactant

The detergent compositions of the invention comprise surfactant which may be of the anionic, non-ionic, cationic or zwitterionic type, or a mixture of these.

The compositions will usually contain anionic surfactant, typically in an amount of 5-30% by weight. For example, the surfactant may all be anionic, or a mixture of anionic and non-ionic surfactant.

Typical examples of anionic surfactant are linear alkyl benzene sulfate (LAS), alpha olefin sulfonate (AOS), alcohol ethoxy sulfate (AES) and natural soap of alkali metals.

In this respect it has surprisingly been found that the lipases and proteases used in this invention have good stability in detergent solutions containing anionic surfactant.

Detergent composition

The compositions of the invention may contain other detergent ingredients known in the art, such as builders, bleaching agents, bleach activators, anti-corrosion agents, sequestering agents, anti-soil redeposition agents, perfumes, stabilizers for the enzymes and bleaching agents and so on. They may also contain enzymes other than lipases and proteases, such as amylases, cellulases and oxidases.

The detergent compositions of the invention can be formulated in any convenient form, such as powders, liquids, etc.

Detergent additive

Enzymes may be included in the detergent compositions of the invention either by adding separate additives containing the lipase and the protease, or by adding the combined lipase/protease additive of the invention.

The lipases and proteases are included in such amounts that the additive of the invention preferably has a lipase activity of 500 to 500,000 LU/g and a protease activity of 0.5 to 10.0 AU(A)/g.

The additive of the invention can be formulated e.g. as dust free granulates, liquids, slurries, etc. Dust free granulates may be produced e.g. according to GB 1,362,365 (Novo) or U.S. Pat. No. 4,106,991 (Novo). The lipase and the protease may be mixed before or after granulation.

In the case of a liquid additive, enzyme stabilizing agents may be included, or the enzymes may be protected according to EP 238,216 (Novo and Albright & Wilson).

EXAMPLES

The following enzymes were used in the examples:

*Fusarium oxysporum* lipase: prepared according to EP 130,064 (Novo)

Alcalase: Product of Novo Industri A/S, protease produced by cultivation of *Bacillus licheniformis*

Savinase and Esperase: products of Novo Industri A/AS, proteases produced by cultivation of alkalophilic Bacillus sp. according to U.S. Pat. No. 3,723,250.

Penicillium lipase: Produced by cultivating *P. cyclopium* according to SU 906,180

Aspergillus lipase: Amano AP 6 ex *A. niger*

*Ps. fluroescens* lipase: Lipase P "Amano"

*Ps. fragi* lipase: Lipase-B, product of Sapporo Breweries Ltd.

The following two detergents were used in the examples:

| | Detergent 1 | Detergent 2 |
|---|---|---|
| LAS | 6.9% w/w | 5.7% w/w |
| AE (alcoholethoxylate) | 4.3% w/w | 4.0% w/w |
| Soap | 1.3% w/w | 0.8% w/w |
| Sodium tripolyphosphate | 36.5% w/w | 29.7% w/w |
| Sodium carbonate | 6.4% w/w | 3.8% w/w |
| Sodium sulfate | 22.3% w/w | 33.0% w/w |
| Sodium silicate | 1.8% w/w | 1.9% w/w |
| Sodium perborate, tetrahydrate | 18.1% w/w | 19.5% w/w |

-continued

| | Detergent 1 | Detergent 2 |
|---|---|---|
| TAED | 1.5% w/w | 1.5% w/w |
| CMC | 0.9% w/w | — |
| TOTAL | 100.0% w/w | 99.9% w/w |

Solutions in the examples were made with tap water of approx. 18° Germany hardness.

Production Example

Lipase from *Pseudomonas cepacia* DSM 3959 and DSM 3401

A culture of each strain on an agar slant was transferred to a 2000 ml shake flask with 800 ml medium of the following composition:

| | |
|---|---|
| Peptone | 6 g/l |
| Trypsin digested casein | 4 g/l |
| Yeast extract | 3 g/l |
| Meat extract | 1.5 g/l |
| Dextrose | 1 g/l |
| Autoclaved at 121° C. for 60 minutes | |

After skaing t 30° C. for 1 day, the broth was used to inoculate a conventional agitated and aerated fermentor containing 300 liter medium with the following composition:

| | |
|---|---|
| Yeast extract | 1 g/l |
| $KH_2PO_4$ | 0.67 g/l |
| $Na_2HPO_4.12H_2O$ | 0.67 g/l |
| Glucose | 0.1 g/l |
| Pluronic ® 60L | 0.4 ml/l |
| Autoclaved for 1 hour at 120° C. | |

After 1 day's fermentation 200 liter broth were used to incoulate a conventional agitated aerated fermentor with 1500 liter medium with the following composition:

| | |
|---|---|
| Yeast extract | 20 g/l |
| Tween-81 | 24 g/l |
| $CaCl_2.2H_2O$ | 0.1 g/l |
| $MgSO_4.7H_2O$ | 2 g/l |
| Pluronic ® 60L | 0.4 ml/l |

Fermentation time was 2 days for DSM 3959 and 3 days for DSM 3401. Additional antifoam agent (Nalco 4302/9) was used. After the fermentation was stopped, the cells were killed by a one hour heat treatment at 55° C., pH 9.5 (adjustment with soda). pH was adjusted to approximately 7.5 (by phosphoric acid) before the broth was evaporated at 35° C. to approximately 200 liters. The lipase was then recovered by a fractionated ethanol precipitation between 50% w/w and 86% w/w ethanol and vacuum dried.

EXAMPLE 1

Lipase stability in detergent solution with protease

Solutions of 4.8 g/l of detergent No. 1 and 4 LU/ml of lipase were incubated for 30 minutes at 30° C. with or without 0.032 AU/l of protease Lipase activity was measured before and after incubation and was expressed in % of the activity added.

| | Without protease | | | Proteases of invention | | | | Reference proteases | | | | | |
|---|---|---|---|---|---|---|---|---|---|---|---|---|---|
| | Water | Detergent | | Fusarium | | Sub. NOVO | | Savinase | | Esperase | | Alcalase | |
| | 0 min | 0 min | 30 min | 0 min | 30 min | 0 min | 30 min | 0 min | 30 min | 0 min | 30 min | 0 min | 30 min |
| Lipases of invention: | | | | | | | | | | | | | |
| *Ps. cepacia* DSM 3401 | 100 | 98 | 95 | 97 | 88 | 103 | 90 | 93 | 12 | 91 | 9 | 100 | 14 |
| *Ps. cepacia* DSM 3959 | 100 | 114 | 108 | 106 | 93 | 116 | 104 | 115 | 13 | 109 | 10 | 116 | 20 |
| *Ps. fluorescens* | 100 | 104 | 102 | 89 | 66 | 103 | 97 | 102 | 13 | 91 | 10 | 101 | 16 |
| *Ps. fragi* | 100 | 206 | 245 | 184 | 239 | 212 | 217 | 165 | 30 | 191 | 24 | 201 | 56 |
| Reference lipases: | | | | | | | | | | | | | |
| Penicillium | 100 | 98 | 12 | 72 | 6 | 96 | 3 | 99 | 12 | 102 | 3 | 98 | 9 |
| Aspergillus | 100 | 10 | 9 | 18 | 16 | 12 | 6 | 14 | 12 | 11 | 14 | 7 | 5 |
| Fusarium oxysporum | 100 | 80 | 12 | 86 | 11 | 80 | 15 | 74 | 11 | 79 | 12 | 76 | 9 |

It is seen that Pseudomonas lipases of the invention have good activity and stability in detergent solution. *Ps. fragi* lipase is strongly activated by detergent as was also observed in EP 204,284. The stability is nearly unaffected by proteases of the invention (*Fusarium* and Subtilisin NOVO), but the stability of these lipases becomes poor by addition of other proteases.

The other detergent lipases tested show poor stability in detergent solution, even without protease.

EXAMPLE 2

Protease stability in detergent solution

A solution of Detergent 1 (5 g/l) and a protease as indicated below (0.03 AU/l) was incubated at 22° C. for the time indicated below. Protease activity before and after incubation was measured on a Titertek Multiscan using a synthetic oligopeptide substrate (Sigma No. S7388, Suc-Ala-Ala-Pro-Phe-pNA).

| | Incubation time, hours | % residual activity |
|---|---|---|
| Proteases of invention: | | |
| Fusarium | 1 | 105 |
| Sub. NOVO | 2.5 | 94 |
| Reference proteases: | | |
| Alcalase ® | 2.5 | 90 |
| Savinase ® | 1 | 91 |
| Esperase ® | 1 | 99 |

It is seen that all the proteases show good stability.

EXAMPLE 3

Lipase stability under washing conditions

Washing solution containing 5 g/l of Detergent 1 or 2, 0.03 AU/l of protease and 4 LU/ml of lipase from *Ps. cepacia* DSM 3401 in tap water was used.

Soiled swatches were prepared by applying 50 μl of olive oil (Sigma No. 0 1500) at 60° C. to a 7×7 cm clean cotton swatch. The swatches were aged for 3 days before use.

In each experiment, 1000 ml of washing solution and 7 swatches were added to a Terg-0-Tometer beaker and left with agitation for 30 minutes at 30° C. Lipase activity in the solution was measured before and after this treatment. Terg-O-Tometer is described in Jay C. Harris: Detergency Evaluation and Testing, Interscience Publishers ltd. (1954), pp. 60–61.

Results are expressed in % of the added lipase activity:

| Protease | Swatch | Detergent 1 | | Detergent 2 | |
|---|---|---|---|---|---|
| | | 0 min | 30 min | 0 min | 30 min |
| None | clean | 114 | 112 | 110 | 106 |
| None | soiled | 113 | 116 | 104 | 93 |
| Protease of invention: | | | | | |
| Fusarium | soiled | 100 | 94 | 104 | 94 |
| Sub. NOVO | soiled | 100 | 93 | 86 | 76 |
| Reference proteases: | | | | | |
| Alcalase ® | soiled | 108 | 20 | 92 | 5 |
| Savinase ® | soiled | 94 | 14 | 71 | 3 |
| Esperase ® | soiled | 70 | 12 | 73 | 2 |

The results without protease show that the lipase is not significantly removed from the washing solution by adsorption to the swatch or the olive oil soiling.

The results further show that the lipase has excellent stability in detergent solution without protease, and nearly the same stability when protease according to the invention is added. Addition of the other proteases drastically reduces the lipase stability.

EXAMPLE 4

Detergency of protease

Washing tests were made with Detergent 1 (5 g/l in tap water) in a Terg-O-Tometer at 30° C. for 20 minutes with 100 rpm stirring. Experiments were made with 0 or 0.03 AU/l of the indicated protease, and with 0 or 6000 LU/l of lipase from *Ps. cepacia* DSM 3401.

Soiled spinach swatches were made on a Mathis Washing and Drying Unit (Werner Mathis AG, Switzerland) in continuous operation, whereby cotton textile passes through spinach juice, is squeezed between two rollers and is then blown dry with 30° C. air (thermostated). The swatches were aged for 3 weeks at 20° C., and were then kept at −18° C. until use.

After washing, the swatches are rinsed in cold water and air dried, and detergency is found by measuring reflectance at 460 nm.

| Protease: | $R_{460}$ at lipase activity | |
|---|---|---|
| | 0 LU/l | 6000 LU/l |
| None | 57.0 | 56.1 |
| Fusarium (invention) | 76.5 | 76.1 |
| Savinase (reference) | 73.8 | 73.1 |

It is seen that the proteases are effective, and that the lipase has no influence on the protease effect.

EXAMPLE 5

Detergency of lipase

Wash trials were carried out with combinations of *Pseudomonas cepacia* DSM 3410 lipase and various proteases, using 4-cycle-soil-wash procedure, as follows:

50×7 cotton swatches were used. Lipid/protein/clay soiling was applied with an emulsion containing (in % by weight):

| | |
|---|---|
| Olive oil | 14.4% |
| Stearic acid | 1.80 |
| Monoglyceride (Grindtek MSP90) | 1.80 |
| Gelatin | 0.90 |
| Kaolin | 1.35 |
| Carbon black (Degussa spez. schwarz 4) | 0.18 |
| Indian ink (Rotring) | 0.18 |
| Water | 79.4 |

Swatches were aged for at least 2 days after each soiling.

The following washing procedure was used:

| | |
|---|---|
| Equipment: | Terg-O-Tometer |
| Detergent: | Det. No. 1, 5 g/l |
| Temperature: | 30° C. |
| Time: | 30 min. |
| Water hardness: | 18° German hardness |
| pH: | not adjusted (approx. 9.5) |
| Lipase dosage: | 0 or 10,000 LU/l |
| Protease dosage: | 0 or 0.3 AU/l |
| Cloth/liquid ratio: | 7 swatches/1000 ml |

After 4 soil-wash cycles, the residual fatty matter was extracted by Soxhlet extraction, and the content of fatty matter (g fatty matter/g textile×100) was determined by weighing, and the composition of the extracted fatty matter was analyzed by TLC/FID. (TG=triglyceride, DG=diglyceride, MG=monoglyceride, FFA=free fatty acid, all given in % by weight of the fatty matter).

| Lipase | Protease | % residual fatty matter | Composition of fatty matter (%) | | | |
|---|---|---|---|---|---|---|
| | | | TG | DG | MG | FFA |
| — | — | 4.81 | 75 | 6 | 14 | 4 |
| *Pseudomonas cepacia* | — | 3.28 | 40 | 24 | 14 | 21 |
| | Reference: | | | | | |
| DSM 3401 | Alcalase | 4.32 | 86 | 15 | 10 | 8 |
| | Savinase | 4.33 | 67 | 16 | 9 | 8 |
| | Esperase | 4.57 | 73 | 12 | 8 | 6 |
| | Invention: | | | | | |
| | Fusarium | 3.55 | 49 | 24 | 12 | 15 |
| | Sub. Novo | 3.49 | 51 | 22 | 12 | 15 |

It is seen that in the absence of protease, lipase serves to reduce the amount of residual fatty matter and to change its composition towards relatively more free fatty acid and less triglyceride. The lipase effect is only slightly reduced by addition of protease according to the invention, but the effect is strongly reduced by the addition of other proteases.

I claim:

1. A detergent composition, comprising (a) a surfactant, (b) a protease selected from the group consisting of:

(i) a protease derived from Fusarium;

(ii) Subtilisin Novo;

(iii) a variant of Subtilisin Novo, wherein Gly at position 166 is replaced with Asn, Ser, Lys, Arg, His, Gln, Ala, or Glu;

(iv) a variant of Subtilisn Novo, wherein Gly at position 169 is replaced with Ser;

(v) a variant of Subtilisin Novo, wherein Met at position 222 is replaced with Gln, Phe, Cys, His, Asn, Glu, Ala or Thr;

(vi) a variant of Subtilisin Novo, wherein Gly at position 166 is replaced with Lys and Met at position 222 is replaced with Cys; or (vii) a variant of Subtilisin Novo, wherein Gly at position 169 is replaced with Ala and Met at position 222 is replaced with Ala; and (c) a lipase derived from Pseudomonas.

2. The composition of claim 1, wherein the protease is derived from *F. oxysporum* or *F. solani.*

3. The composition of claim 1, wherein the lipase is derived from *Ps. cepacia, Ps. fluorescens, Ps. fragi, Ps. nitroroducens, Ps. mephitica, Ps. stutzeri, Ps. pseudoalcaligenes, Ps. gladioli* or *Ps. aerugionosa.*

4. The composition of claim 1, wherein the protease activity is above 0.0001 AU(A)/g.

5. The composition of claim 1, wherein the lipase activity is above 20 LU/g.

6. The composition of claim 1, wherein the surfactant is an anionic surfactant.

7. The composition of claim 6, wherein the anionic surfactant is alkyl bezene sulfonate, alpha olefin sulfonate or alcohol ethoxy sulfate.

8. An enzymatic detergent additive comprising (a) a protease selected from the group consisting of:

(i) a protease derived from Fusarium;

(ii) Subtilisin Novo;

(iii) a variant of Subtilisin Novo, wherein Gly at position 166 is replaced with Asn, Ser, Lys, Arg, His, Gln, Ala or Glu;

(iv) a variant of Subtilisin Novo, wherein Gly at position 169 is replaced with Ser;

(v) a variant of Subtilisin Novo, wherein Met at position 222 is replaced with Gln, Phe, Cys, His, Asn, Glu, Ala or Thr;

(vi) a variant of Subtilisn Novo, wherein Gly at position 166 is replaced with Lys and Met at position 222 is replaced with Cys; or (vii) a vriant of Subtilisin Novo, wherein Gly at position 169 is replaced with Ala and Met at position 222 is replaced with Ala; and (b) a lipase derived from Pseudomonas.

9. The additive of claim 8, wherein the lipase activity is above 500 LU/g.

10. The additive of claim 8, wherein the protease activity is above 0.5 AU(A)/g.

* * * * *

UNITED STATES PATENT AND TRADEMARK OFFICE
CERTIFICATE OF CORRECTION

| | | |
|---|---|---|
| PATENT NO. | : | 5,078,898 |
| DATED | : | January 7, 1992 |
| INVENTOR(S) | : | Mette Jars |

It is certified that error appears in the above-identified patent and that said Letters Patent is hereby corrected as shown below:

Col. 3, line 37: delete "JP 56-28,515B" and insert --JP 56-28,516B--

Col. 5, line 40: delete "skaing t" and insert --shaking at--

Col. 5, line 53: delete "incoulate" and insert --inoculate--

Col. 9, line 22, claim 4: delete "0.0001" and insert --0.001--

Col. 10, line 2, claim 7: delete "bezene" and insert --benzene--

Col. 10, line 19, claim 8: delete "vriant" and insert --variant--

Signed and Sealed this

Sixteenth Day of November, 1999

*Attest:*

*Attesting Officer*

Q. TODD DICKINSON

*Acting Commissioner of Patents and Trademarks*